US005480243A

United States Patent [19]

Kikkawa et al.

[11] Patent Number: 5,480,243

[45] Date of Patent: Jan. 2, 1996

[54] INK JET RECORDING SYSTEM

[75] Inventors: Shoshi Kikkawa, Kawasaki; Manabu Kanazawa, Yokohama; Isao Tsukada, Kawasaki, all of Japan

[73] Assignee: Canon Kabushiki Kaisha, Tokyo, Japan

[21] Appl. No.: 384,686

[22] Filed: Feb. 6, 1995

Related U.S. Application Data

[63] Continuation of Ser. No. 276,500, Jul. 18, 1994, abandoned, which is a continuation of Ser. No. 911,031, Jul. 9, 1992, abandoned.

[30] Foreign Application Priority Data

Jul. 12, 1991 [JP] Japan ..... 3-198554
Jul. 23, 1991 [JP] Japan ..... 3-205668

[51] Int. Cl.[6] ..... B41J 11/22

[52] U.S. Cl. ..... 400/354; 347/30; 347/31; 347/85; 347/92

[58] Field of Search ..... 400/352, 354, 400/357, 691, 692; 347/29, 30, 31, 33, 34, 36, 85, 89, 90, 92; 346/1–7, 140

[56] References Cited

U.S. PATENT DOCUMENTS

| | | | |
|---|---|---|---|
| 4,175,266 | 11/1979 | Narano et al. | 400/126 |
| 4,177,471 | 12/1979 | Mitchell | 346/140 R |
| 4,313,124 | 1/1982 | Hara | 346/140 R |
| 4,345,262 | 8/1982 | Shirato et al. | 346/140 R |
| 4,361,845 | 11/1982 | Smith | 347/90 |
| 4,459,600 | 7/1984 | Sato et al. | 346/140 R |
| 4,463,359 | 7/1984 | Ayata et al. | 346/1.1 |
| 4,558,333 | 12/1985 | Sugitani et al. | 346/140 R |
| 4,567,494 | 1/1986 | Taylor | 347/30 |
| 4,723,129 | 2/1988 | Endo et al. | 346/1.1 |
| 4,740,796 | 4/1988 | Endo et al. | 346/1.1 |
| 4,751,527 | 6/1988 | Oda | 347/91 |
| 4,853,717 | 8/1989 | Harmon et al. | 400/126 |
| 4,874,262 | 10/1989 | Yokoi et al. | 400/216.1 |
| 4,931,955 | 6/1990 | Okabayashi et al. | 400/126 |
| 4,947,190 | 8/1990 | Mizusawa et al. | 347/33 |
| 4,959,660 | 9/1990 | Suzuki et al. | 347/34 |
| 4,967,204 | 10/1990 | Terasawa et al. | 346/1.1 |
| 4,979,835 | 12/1990 | Beck et al. | 400/59 |
| 4,979,835 | 12/1990 | Beck et al. | 400/59 |
| 5,018,884 | 5/1991 | Hirano et al. | 400/126 |
| 5,032,034 | 7/1991 | Bischof et al. | 400/660 |

(List continued on next page.)

FOREIGN PATENT DOCUMENTS

| | | |
|---|---|---|
| 1120320 | 2/1984 | European Pat. Off. . |
| 0120320 | 10/1984 | European Pat. Off. . |
| 0306591 | 3/1989 | European Pat. Off. . |
| 0471374 | 2/1992 | European Pat. Off. . |
| 54-56847 | 5/1979 | Japan . |
| 54-29791 | 9/1979 | Japan . |
| 54-29792 | 9/1979 | Japan . |
| 59-123670 | 7/1984 | Japan . |
| 59-138461 | 8/1984 | Japan . |
| 60-71260 | 4/1985 | Japan . |

*Primary Examiner*—Eugene H. Eickholt
*Attorney, Agent, or Firm*—Fitzpatrick, Cella, Harper & Scinto

[57] ABSTRACT

The present invention provides an ink jet recording system having a recording means for performing the recording by discharging ink onto a recording medium, wherein an ink receiving portion for receiving ink discharged from the recording means in no association with the recording regarding the recording medium is arranged within a width zone of the recording medium and out of a recordable area of the recording medium. The present invention further provides a carriage shifting apparatus comprising a body frame, a carriage reciprocally shiftable within the body frame, and a guide member having both ends supported by both side plates of the body frame and adapted to guide the carriage, and wherein a support portion provided on at least one ends of the guide member is non-detachably attached to at least one of the side plates by fitting the support portion into a guide member supporting portion provided in the guide plate while elastically deforming the guide member supporting portion.

12 Claims, 16 Drawing Sheets

U.S. PATENT DOCUMENTS

| | | | |
|---|---|---|---|
| 5,040,000 | 8/1991 | Youoi | 347/30 |
| 5,081,472 | 1/1992 | Fisher | 400/126 |
| 5,092,690 | 3/1992 | Grimm et al. | 346/75 |
| 5,148,203 | 9/1992 | Hirano | 346/75 |
| 5,164,748 | 11/1992 | Katayanag et al. | 347/30 |
| 5,225,852 | 7/1993 | Uchida et al. | 400/708 |
| 5,262,802 | 11/1993 | Karita et al. | 347/87 |
| 5,266,974 | 11/1993 | Koitabashi et al. | 347/33 |
| 5,270,738 | 12/1993 | Takahashi et al. | 347/29 |

INK JET RECORDING SYSTEM

This application is a continuation of application Ser. No. 08/276,500 filed Jul. 18, 1994, now abandoned, which is a continuation of application Ser. No. 07/911,031 filed Jul. 9, 1992, now abandoned.

BACKGROUND OF THE INVENTION

1. Field of the Invention

The present invention relates to a recording system, and more particularly, it relates to an ink jet recording system having a recording means for performing the recording by discharging ink toward a recording medium.

2. Related Background Art

In recording systems such as printers, copying machines, facsimiles and the like, or recording systems used as output terminals of composite electronic equipments or work stations including a computer, word processor or the like, an image is recorded on a recording medium (recording sheet) such as a paper sheet or a plastic film on the basis of image information. Such recording systems can be grouped into ink jet recording systems, wire dot recording systems, thermal recording systems and laser beam recording systems in accordance with the recording type.

In a serial recording system of serial scan type wherein a main scan is effected in a direction perpendicular to a recording medium feeding direction (auxiliary scanning direction), after the recording medium was set at a predetermined recording position, an image is recorded (main-scanned) by a recording means mounted on a carriage movable along the recording medium to perform a one-line recording, the recording medium is then line-spaced by a predetermined amount (pitch feeding), and then a next image is recorded (main-scanned) on the stopped recording medium to perform a next one-line recording. By repeating such recording operations, the recording is effected on the whole recording medium (one-page recording). On the other hand, in a recording system of line type wherein the recording is effected only by the auxiliary scans in the recording medium feeding direction, after the recording medium was not at a predetermined recording position, a one-line recording is performed en bloc, the recording medium is then line-spaced by a predetermined amount (pitch feeding), and then a next one-line recording is performed en bloc. By repeating such recording operations, the recording is effected on the whole recording medium.

Among the above-mentioned recording systems, the recording system of the ink jet type (ink jet recording system) performs the recording by discharging ink from a recording means (recording head) onto the recording medium, and has advantages that the recording means can easily be made compact, that a fine image can be recorded at a high speed, that an image can be recorded on a plain sheet without any treatment, that the running cost is cheap, that there is substantially no noise due to non-impact recording type, and that a color image can easily be recorded by using plural color inks. Moreover, in the ink jet recording system of line type utilizing the recording means of line type having a plurality of discharge openings arranged along a width of the recording medium, the recording can be effected at a higher speed.

Particularly, in the recording means (recording head) of the type wherein the ink is discharged by using thermal energy, a recording head having liquid passage arrangement (discharge opening arrangement) with high density can easily be manufactured by forming electrical/thermal converters, electrodes and liquid passage walls patterned on a substrate and a top plate through etching, depositing and sputtering techniques, thereby making the head more compact. On the other hand, there are many requirements for the materials of the recording medium. Recently, thin paper sheets or worked paper sheets (such as filing punch-perforated paper sheets, paper sheets with perforated lines, or paper sheets having various configurations) have been requested, as well as plain paper sheets or resin films (OHP sheets).

In the above-mentioned ink jet recording system, there has been generally adopted an operation that a predetermined amount of ink is discharged at a predetermined position in the system immediately before a normal recording operation (for recording an image on a predetermined position of the recording medium by discharging a predetermined amount of ink) is effected after a power source of the system is turned ON or after the system has been left in an operative condition for a predetermined long time with the power source being turned ON.. Such an operation for discharging the ink in other than the normal recording operation is referred to as "preliminary discharge".

The purpose of the preliminary discharge is as follows. In the ink jet recording system, since the image is formed on the recording medium by selectively discharging the liquid ink from the discharge openings of the recording head, particularly under the low temperature and low humidity circumstances, the ink tends to be hard to discharge from the discharge openings because of an increase in the viscosity of the ink due to the vaporization of ink liquid or the low temperature at the discharge openings. Thus, if the normal recording operation is immediately started after the recording system has been left for a long time, at the initial phase of the recording operation, it is feared that the poor recording such as the imperfect image formation or ink deflection occurs. To avoid this, immediately before the normal recording operation is performed, an operation is performed so that the viscosity of the ink near the discharge openings is returned to the normal condition by discharging a predetermined amount of ink from the discharge openings of the recording head to discharge the viscous ink near the discharge openings, i.e., the preliminary discharge operation. By effecting such preliminary discharge, it is possible to prevent the occurrence of the above-mentioned poor recording.

However, in conventional ink jet recording systems, in many cases, a position was set out in a widthwise direction of the system, where the ink ejected by the preliminary discharge could be received (i.e., a position where the preliminary discharge is effected) outside the width of a maximum recordable recording medium (recording sheet and the like). Thus, a space exclusive to the preliminary discharge had to be reserved, with the result that the width of the recording system had to be increased accordingly, thereby making the recording system less compact.

By the way, in the past, as shown in FIG. 21, many small-sized recording systems such as word processors, printers, portable calculators are of a so-called serial type wherein the recording is effected by reciprocally shifting a carriage 151 mounting a recording head 150 thereon in a widthwise direction of a recording sheet 152. In such a serial recording system, the carriage 151 on which the recording head 150 is mounted is reciprocally shifted along a guide shaft 153 arranged in parallel with the recording sheet 152. The guide shaft 153 is normally inserted into through holes 154*c* formed in side plates 154*a*, 154*b* of the recording system and is fixed with respect to a longitudinal (thrust) direction thereof by fitting E-rings into grooves formed in both ends of the guide shaft or by securing one end of the guide shaft to at least one of the side plates by means of a holder plate 155 as shown in FIG. 21.

However, in the above-mentioned arrangement for regulating the longitudinal movement of the guide shaft 153, since the E-rings or the holder plate 155 must be used as mentioned above, the number of parts is increased and the assembling processes are also increased, thus comprising the operability and making the system expensive.

SUMMARY OF THE INVENTION

The present invention aims to eliminate the above-mentioned conventional drawbacks regarding the compactness of the recording system. An object of the present invention is to provide an ink jet recording system which can save space for receiving ink discharged from a recording means by preliminary discharge during other than a normal recording operation, thereby reducing the width of the recording system, to make the system more small-sized and light-weight.

To achieve the above object, the present invention provides an ink jet recording system for performing the recording by discharge ink from a recording means onto a recording medium, wherein a position of an ink receiving portion for receiving the ink discharged from the recording means during other than a normal recording operation when the recording is effected on the recording medium is positioned within a width area of the recording medium.

That is to say, the most important feature of the present invention is that the ink receiving portion for receiving the ink discharged by the ink discharge such as the preliminary discharge which does not directly relate to the recording is arranged within a width zone of the recording medium and out of a recordable area of the recording medium.

In general, it is rare that the image is recorded on the recording medium through the whole width thereof (from the proximity of one edge of the recording medium to the proximity of the other edge of the recording medim), and the both edge portions of the recording medium generally are left as blank portions (i.e., not recorded). If the image is recorded on the recording medium from the proximity of one edge of thereof to the proximity of the other edge thereof, the recorded image itself is hard to be seen and the treatment of the recording medium will be worsened. Further, it is impossible or difficult to perforate holes in the edge portion for binding the recorded sheets. In addition, as to a recording medium previously having perforated holes at its both edge portions for feeding the recording medium (a fanfold paper sheet and the like), it is disadvantageous to record the image from the proximity of during other edge of the recording medium.

The present invention attempts to make a recording system small-sized by effectively utilizing the edge portions of the recording medium which are the "dead angle" in the conventional cases. Further, according to the present invention, since the scanning range of the carriage can be decreased in comparison with the conventional cases, it is possible to increase the whole recording speed of the recording system in comparison with the conventional cases.

Another object of the present invention is to provide an ink jet recording system comprising a body frame, a carriage reciprocally shiftable within the body frame, and a guide member having both ends supported by both side plates of the body frame and adapted to guide the carriage, and wherein a support portion formed on an end of the guide member is forcibly fitted into a guide member supporting portion formed on at least one of the side plates of the body frame by elastically deforming the supporting portion to non-detachably attach the guide member to the body frame.

With this arrangement, since the support portion of the guide member is forcibly fitted into the supporting member of the body frame, the guide member is non-detachably attached to the body frame. Therefore, unlike to the conventional cases, there is no need to use E-rings or a holder plate, thus reducing the number of parts and making the system small-sized.

DETAILED DESCRIPTION OF THE PREFERRED EMBODIMENTS

Figure 1:
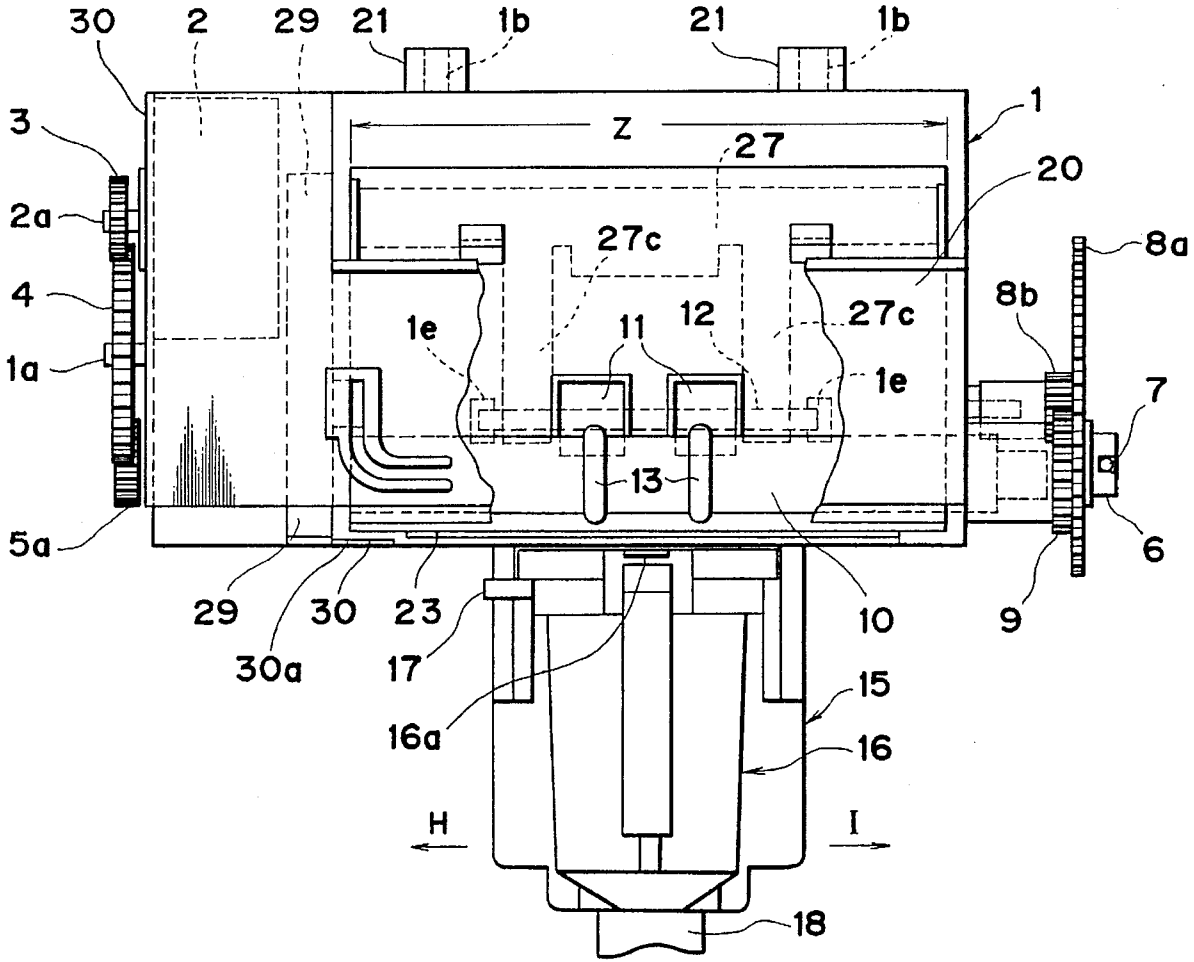
FIG. 1 is a plan view of an ink jet recording system according to a preferred embodiment of the present invention.
Figure 2:
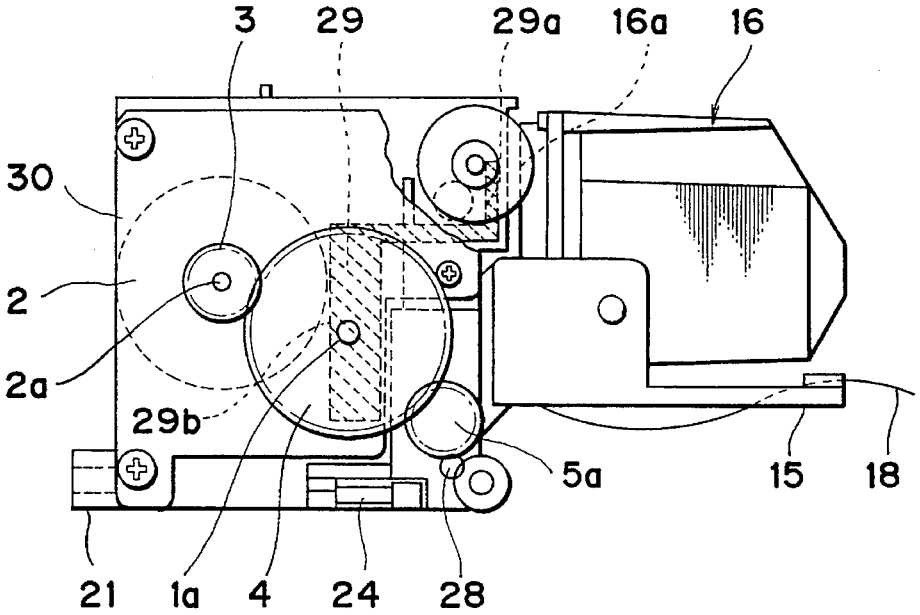
FIG. 2 is a left side view of the ink jet recording system of FIG. 1.
Figure 3:
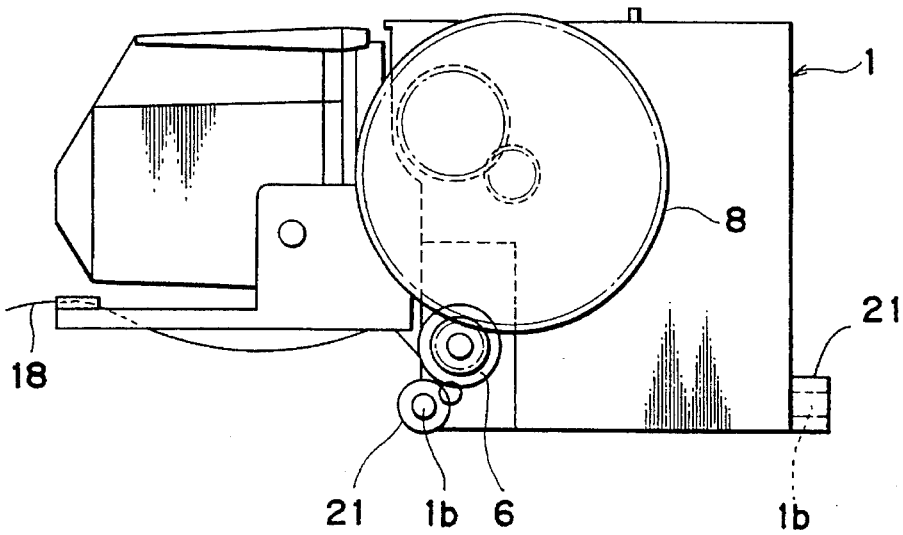
FIG. 3 is a right side view of the ink jet recording system of FIG. 1.

The present invention will now be explained in connection with embodiments thereof with reference to the accompanying drawings. FIG. 1 is a plan view of an ink jet recording system according to a first embodiment of the present invention, FIG. 2 is a left side view of the ink jet recording system, FIG. 3 is a right side view of the ink jet recording system, FIG. 4 is an elevational view of the ink jet recording system, and FIG. 5 is a sectional side view of the ink jet recording system.

In FIGS. 1 to 5, the reference numeral 1 denotes a body frame of an ink jet recording system; 2 denotes a stepping motor as a drive source; and 3 denotes a motor gear secured to a motor shaft 2a of the stepping motor 2. The motor 2 is secured to the body frame 1 and is connected to a control circuit (not shown). The motor gear 3 is meshed with a transmission gear 4 rotatably mounted on a shaft 1a supported by the body frame 1.

A lead screw 5 is rotatably supported by the body frame 1, and a gear portion 5a secured to one end of the lead screw is meshed with the transmission gear 4. Further, a sheet feeding transmission gear 6 is secured to the other end of the lead screw 5 by a lock pin 7. The lead screw 5 is inserted into holes formed in the body frame 1 for rotational movement. A sheet feed intermediate gear 8 comprises a gear portion 8*a* meshed with the sheet feed transmission gear 6 and a gear portion 8*b* meshed with a clutch gear 9. The sheet feed intermediate gear 8 is rotatably mounted on a shaft supported by the body frame 1.

Figure 4:
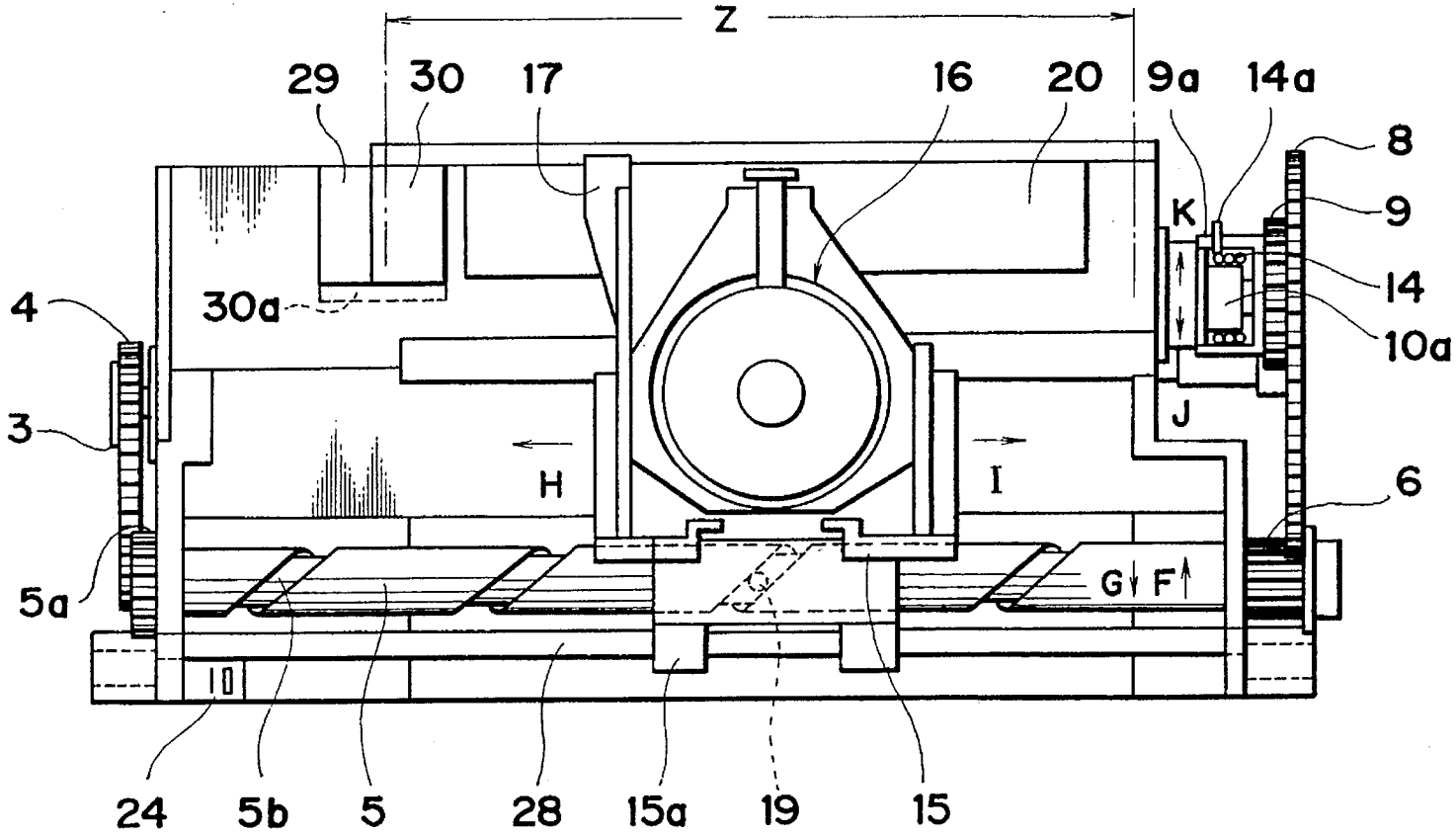
FIG. 4 is an elevational view of the ink jet recording system of FIG. 1.
Figure 5:
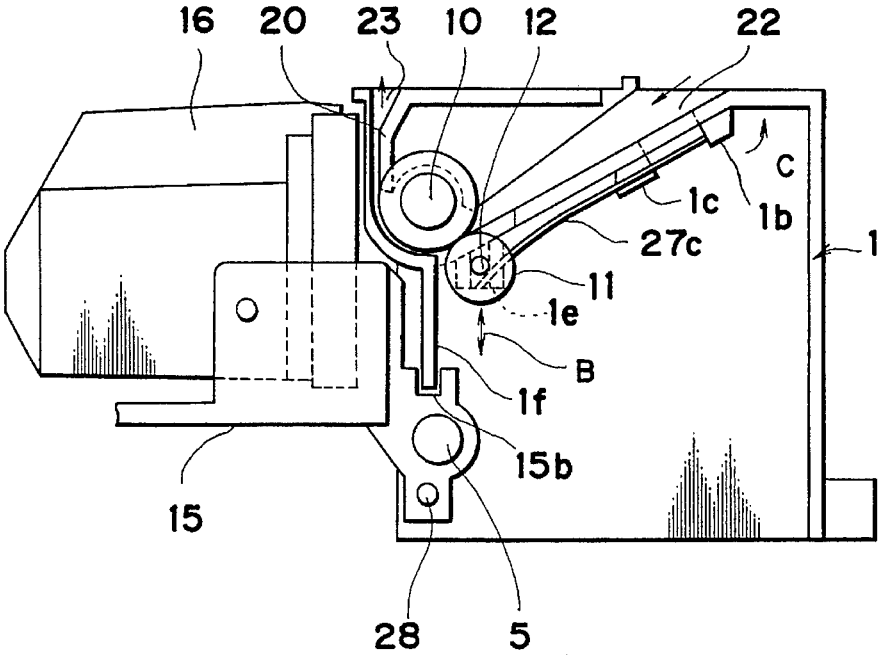
FIG. 5 is a sectional side view of the ink jet recording system of FIG. 1.

As shown in FIG. 4, an end 14*a* of a clutch spring 14 is engaged by a recessed portion 9*a* of the clutch gear, and the clutch spring 14 is wound around an end portion 10*a* of a sheet feed roller 10 (FIGS. 1 and 5). The sheet feed roller 10 is inserted into a hole formed in the body frame 1 for rotational movement. In FIGS. 1 to 5, feed ring members 13 made of elastic material (for example, rubber material) are mounted around the sheet feed roller 10 at a central area thereof, and pinch rollers 11 are disposed in confronting relation to the feed ring members 13. The pinch rollers 11 are rotatably mounted on a pinch roller shaft 12 which is received in recessed portions 1*e* formed on the frame 1 for rotational movement and shifting movement in directions B (FIG. 5). The pinch roller shaft 12 is urged against the sheet feed roller 10 by arm portions 27*c* (FIGS. 1 and 5) of a pinch roller spring 27.

As shown in FIG. 5, the pinch roller spring 27 is secured to the body frame 1 via pinch roller spring receiving portions 1*c*, 1*d* of the frame. The receiving portions 1*c* support root portions of the arm portions 27*c* of the pinch roller spring 27, and the receiving portion 1*d* bears a bending force (arrow C in FIG. 5) of the pinch roller spring 27 around the receiving portions 1*c*.

Next, a recording means and associated elements will be described.

In FIGS. 1 to 5, a recording head 16 is mounted on a carriage 15 which is guided in the directions H, I (left and right reciprocal directions) along a guide shaft 28. The lead screw 5 is provided at its peripheral surface with a spiral groove 5*b* (FIG. 4) into which a pin 19 formed on the carriage 15 is received. Further, as shown in FIG. 5, the carriage 15 is provided with a recessed 10 portion 15*b*. The carriage 15 is guided in the left and right reciprocal directions also by the engagement between the recessed portion 15*b* and a wall 1*f* of the frame 1, as well as the above-mentioned guide shaft 28. As shown in FIG. 5, a platen 20 is removably mounted on the body frame 1, and a sheet-shaped recording medium such as a paper sheet or a resin film is inserted into an inlet 22 and is ejected from an outlet 23.

In FIGS. 1 to 5, a flexible circuit board 18 for supplying an image signal and electric power from the control circuit (not shown) to the recording head 16 is electrically connected to the recording head 16 via a set lever 17. A detection switch 24 for detecting a home position of the carriage 15 is provided so that, when an end 15*a* (FIG. 4) of the carriage 15 shifted to the home position pushes the detection switch 24, the home position of the carriage 15 is detected. The detection switch 24 is also connected to the control circuit (not shown). A plurality of attachment leg portions 21 made of elastic material such as rubber and adapted to support the recording system are inserted onto projections 1*b* formed on the body frame 1 at desired plural positions.

The recording head 16 is of the type such that the ink is discharged by utilizing thermal energy, and is provided with electrical/thermal converters for generating the thermal energy. Further, the recording head 16 is so designed that the ink droplets are selectively discharged to perform the recording on the basis of growth and contraction of bubbles due to the film boiling generated by the thermal energy applied by the selected electrical/thermal converters.

Figure 6:
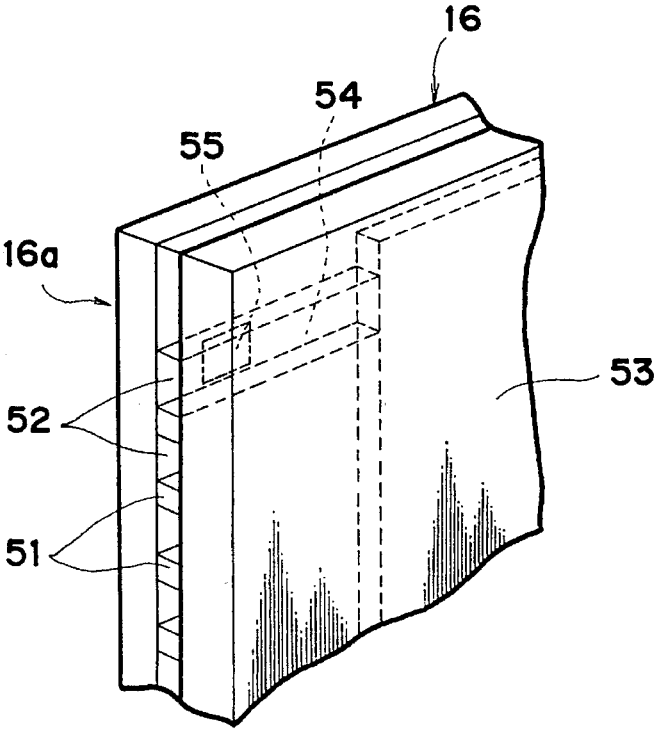
FIG. 6 is a schematic partial perspective view showing a construction of an ink discharge portion of a recording means (recording head) of the ink jet recording system of FIG. 1.

FIG. 6 is a partial perspective view schematically showing the arrangement of an ink discharge portion 16*a* of the recording head 16. In FIG. 6, the recording head includes a discharge opening surface 51 which faces the recording medium across a predetermined distance (for example, about 0.5– 1.0 mm) and which is provided with a plurality of discharge openings 52 arranged at a predetermined pitch. The electrical/thermal converters (for example, heating resistive bodies) 55 for generating the energy for discharging the ink are arranged along walls of liquid passages 54 communicating the corresponding discharge openings 52 with a common liquid chamber 53. In the illustrated embodiment, the recording head 16 is mounted on the carriage 15 in such a manner that the discharge openings 52 are arranged along a direction transverse to a scanning direction (shifting direction)of the carriage 15. In this way, there is provided a recording head 16 wherein the ink droplets are discharged from the discharge openings 52 due to the film boiling of ink in the corresponding liquid passages 54 by selectively energizing the electrical/thermal converters 55 in response to the image signal or discharge signal.

Next, the recording operation will be concretely explained.

When the stepping motor 2 is rotated in the predetermined direction on the basis of a drive signal from the control circuit, the lead screw 5 is rotated in the direction F in FIG. 4 via the transmission gear 4 and the like, thus shifting the carriage 15 in the direction H via the pin (shaft) 19 engaged by the spiral groove 5*b* of the lead screw. When the carriage is shifted by the predetermined amount, the end portion 15*a* of the carriage 15 turns the detection switch 24 ON, thus ascertaining the home position. At this point, the drive signal to the stepping motor 2 is reversed to rotate the lead screw 5 in the direction 6, thus shifting the carriage 15 in the direction I. After the carriage is shifted in the direction I by the predetermined amount, a record signal is supplied to the recording head 16, thus selectively discharging the ink droplets from the discharge openings 52 of the ink discharge portion 16*a* to record an image on the recording medium such as the paper sheet, resin film and the like.

The shifting movement of the carriage 15 in the direction I, i.e., the rotation of the lead screw 5 in the direction G is transmitted to the sheet feed transmission gear 6 and the sheet feed intermediate gear 8, thereby rotating the clutch gear 9 in a direction shown by the arrow J (FIG. 4). In this case, however, since the clutch gear is rotated to loosen the clutch spring 14, a rotational force is not transmitted to the feed roller 10, with the result that the recording medium is not fed or moved.

After the recording is performed on the recording sheet while the carriage 15 is being shifted in the direction I by the predetermined amount, the drive signal to the stepping motor 2 is reversed again to rotate the lead screw 5 in the direction F, thereby shifting the carriage 15 in the direction H. In this case, the clutch gear 9 is rotated in a direction shown by the arrow K so that the clutch spring 14 is tightened to drive the end portion 10*a* of the feed roller 10. Consequently, the feed roller 10 is driven, thereby line-spacing the recording medium by a predetermined amount. In a series of operations as mentioned above, by shifting the carriage 15 in the direction I and the direction H by the same amount, it is possible to keep the amount of the line-spacing of the recording medium constant.

Figure 7:
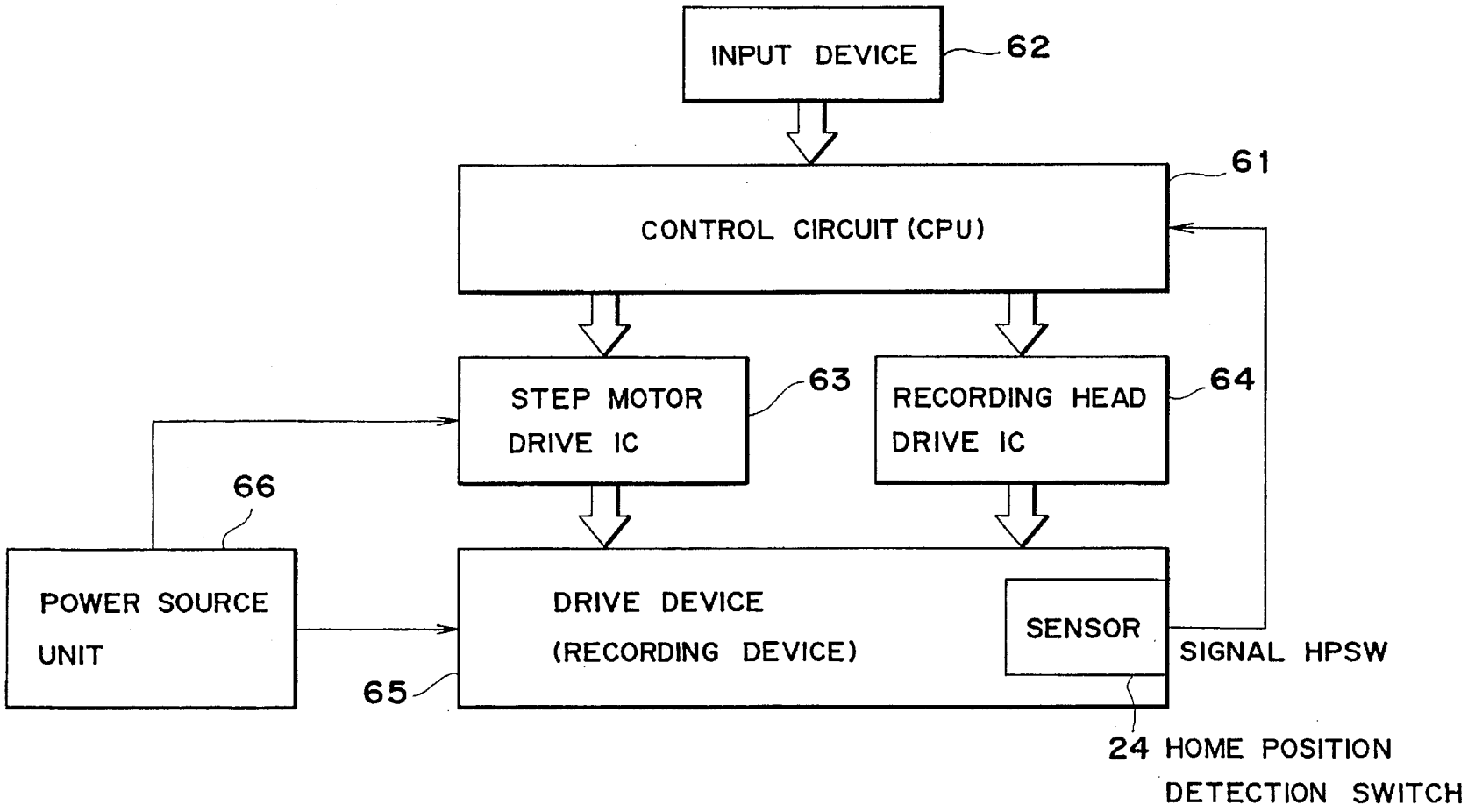
FIG. 7 is a block diagram showing a schematic construction of a control system of the ink jet recording system of FIG. 1.

In the ink jet recording system as mentioned above, the image is formed on the recording medium by selectively discharging the ink droplets from the discharge openings in response to the image signal applied from the control circuit (CPU) to the recording head 16 while the carriage 15 mounting the recording head 16 thereon is being shifted in the direction H or the direction I on the basis of the signal from the control circuit. FIG. 7 is a block diagram of a control system for performing such recording operation.

In FIG. 7, when a record signal is inputted to a control circuit 61 from an input device 62 such as a keyboard, the control circuit 61 controls a recording device 65 as a drive device via stepping motor (carriage motor) drive IC 63 and a recording head drive IC 64. The stepping motor drive IC 63, recording head drive IC 64 and recording device 65 are supplied with drive energy from a power source unit 66. Incidentally, a detection signal from the home position detection switch 24 (FIG. 4) for the carriage 15 is sent to the control circuit 61.

In the ink jet recording system, after the power source was turned ON or after the recording system has been left in an operation condition for a long time, when a predetermined condition is attained, the preliminary discharge is performed. The preliminary discharge is an operation wherein a predetermined amount of ink is discharged from the discharge openings 52 at a predetermined position in the recording system independently of the recording operation, and is effected, for example, immediately before the recording operation, i.e., the operation for forming the image on the recording medium by discharging the predetermined amount of ink onto the predetermined position on the recording medium. Incidentally, the preliminary discharge is effected to prevent poor discharge from the recording head 16, thereby removing the viscous or solidified ink or air/ink mixture in the vicinity of the discharge openings 52 to eliminate the possibility of the poor recording such as the blank in the image and/or dot deflection. Further, the preliminary discharge is generally effected when the power source of the recording system is built-up or immediately before the first recording is performed after a predetermined time has elapsed from the energization of the power source. In addition, the preliminary discharge is effected so that the ink is discharged toward an ink absorber (porous member having good ink absorbing ability) mounted at a preselected position in the recording system to be absorbed by the ink absorber.

According to the present invention, in the case where the ink is discharged during other than the normal recording operation (for example, in case of the preliminary discharge), a position of an ink receiving portion for receiving the discharged ink, i.e., a position where the ink is discharged other than the normal recording operation is .selected within a width of the recording medium. The width of the recording medium (normally, a width of the maximum recordable recording sheet) is shown in FIGS. 1 and 4 as a zone Z.

In the above-mentioned first embodiment, as shown in FIGS. 1 and 4, an ink receiving portion 30 for receiving the ink discharged during other than the normal recording operation (for example, by the preliminary discharge) is disposed within the width zone Z of the recording medium. The ink receiving portion 30 is constituted by a thin wall disposed in front of a platen surface of the platen 20 (left end of the platen 20 in FIG. 4) with a predetermined gap therebetween. Accordingly, an edge (left edge) of the recording medium is moved or line-spaced through the gap between the platen 20 and the ink receiving portion 30. The ink receiving portion 30 is provided at its bottom with an ink reservoir passage 30*a*, and an ink absorber 29 made of porous material having good ink absorbing ability is disposed at the outside (left side in FIG. 4) of the ink receiving portion 30 and is contiguous with the ink reservoir passage 30*a*. With this arrangement, the ink discharged into the ink receiving portion 30 flows down along the ink receiving portion (thin wall) to reach the ink reservoir passage 30*a* and then permeates into the ink absorber 29, and, thus, is absorbed by the latter.

As mentioned above, according to the first embodiment, since the ink receiving portion 30 for receiving the ink discharged during other than the normal recording operation (for example, by the preliminary discharge) is disposed within the width zone Z of the recording medium, there is no need to provide additional space for installing the ink receiving portion 30, thus reducing the widthwise dimension of the recording system accordingly, whereby the recording system can be made small-sized and light-weighted. Incidentally, the ink receiving portion 30, ink reservoir passage 30*a* and ink absorber 29 may be arranged at an opposite position (right side) symmetrical with the illustrated position with respect to the width zone Z of the recording medium.

Figure 8:
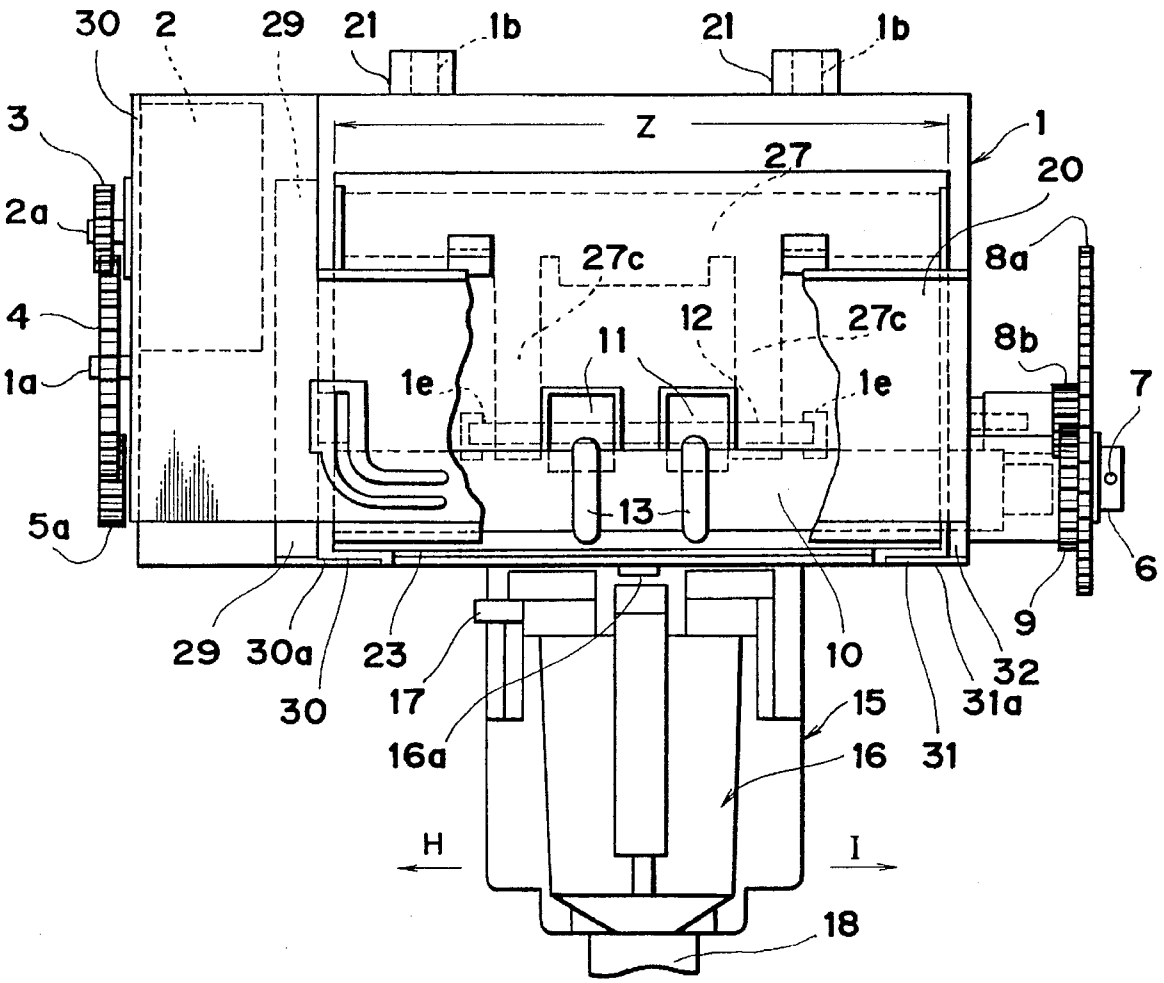
FIG. 8 is a plan view of an ink jet recording system according to another embodiment of the present invention.

Next, a second embodiment of the present invention will be explained. FIG. 8 is a plan view of an ink jet recording system according to a second embodiment of the present invention, and FIG. 9 is an elevational view of the ink jet recording system of FIG. 8.

Figure 9:
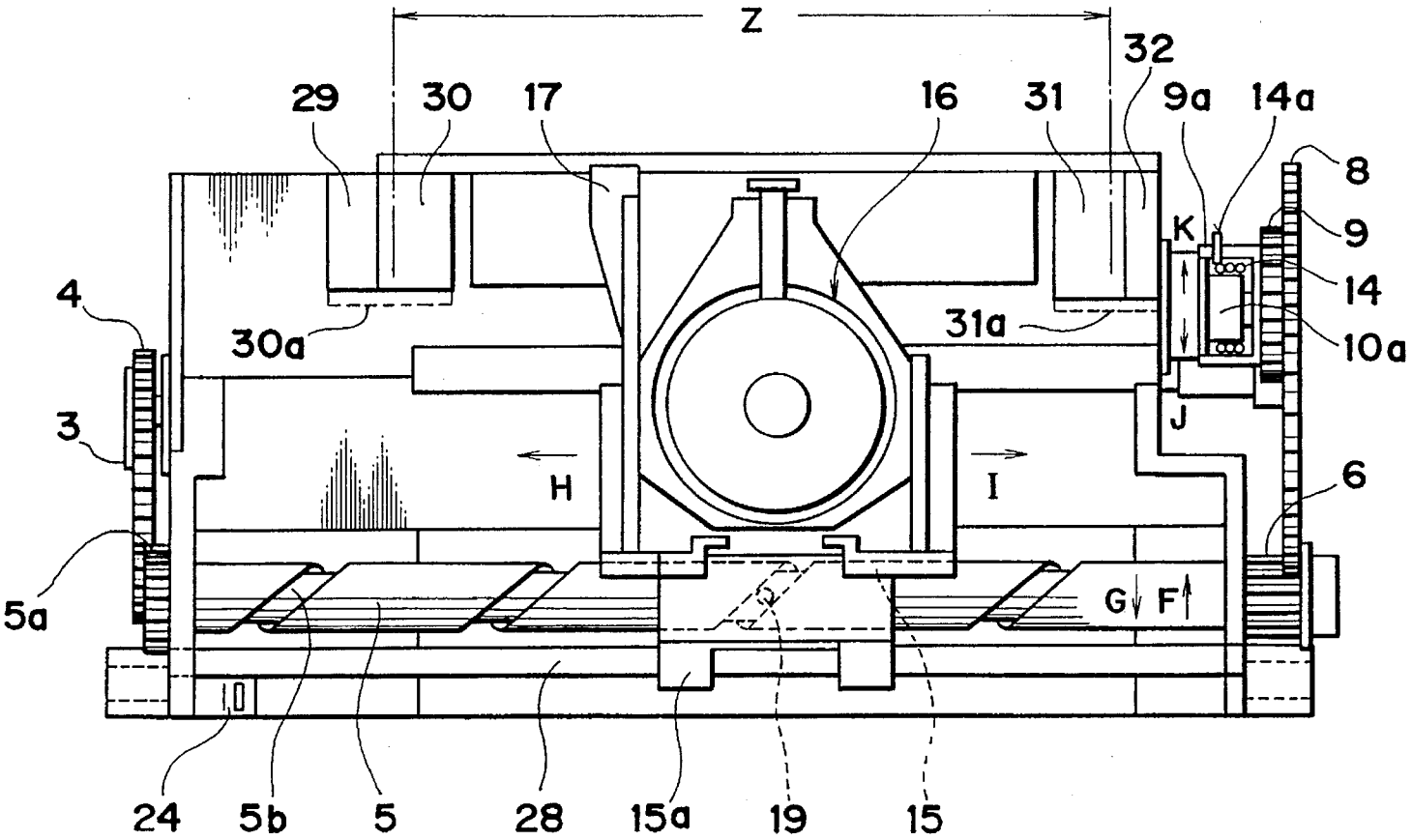
FIG. 9 is an elevational view of the ink jet recording system of FIG. 8.

In the ink jet recording system shown in FIGS. 8 and 9, ink receiving portions 30 and 31 for receiving the ink discharged from the discharge openings 52 during other than the normal recording operation (for example, by the preliminary discharge) are arranged on both the left and right sides of a zone Z of a width of the recording medium (normally, a width of the maximum recordable recording medium). Both ink receiving portions 30, 31 are disposed within the width zone Z of the recording medium. Further, each ink receiving portion 30, 31 is constituted by a thin wall disposed in front of one of platen surfaces of the platen 20 with a predetermined gap therebetween. Accordingly, left and right edges of the recording medium are moved or line-spaced through the gap between the platen 20 and the left and right ink receiving portions 30, 31. The other construction of the ink jet recording system shown in FIGS. 8 and 9 is the same as that of the ink jet recording system according to the first embodiment shown in FIGS. 1 to 5. Thus, the same elements are designated by the same reference numerals and the detailed explanation thereof will be omitted.

Also in this second embodiment, each ink receiving portion 30, 31 is provided at its bottom with an ink reservoir passage 30*a*, 31*a*, and ink absorbers 29, 32 made of porous material having good ink absorbing ability are disposed outside of the ink receiving portions 30, 31, respectively, contiguous with the ink reservoir passages 30*a*, 31*a*, respectively. With this arrangement, the ink discharged into either the ink receiving portion 30 or the ink receiving portion 31 flows down along the ink receiving portion (thin wall) to reach the corresponding ink reservoir passage 30*a* or 31*a* and then permeates into the corresponding ink absorber 29 or 32, and, thus, is absorbed by the latter.

As in the first embodiment, also according to the second embodiment, since the ink receiving portions 30, 31 for receiving the ink discharged in other than the normal recording operation (for example, by the preliminary discharge) are disposed within the width zone Z of the recording medium, there is no need to provide additional spaces for installing the ink receiving portions 30, 31, thus reducing the widthwise dimension of the recording system accordingly, whereby the recording system can be made small-sized and light-weight.

Incidentally, in the illustrated embodiments, while the ink jet recording system having the single recording means was explained, the present invention may be similarly applied to a color ink jet recording system having a plurality of recording means using plural different color inks or a color gradating ink jet recording system having a plurality of recording means using plural different density (same color) inks, as well as the ink jet recording system having the single recording means, regardless of the number of the recording means, with the same technical advantages. Further, as the recording means (recording head) used with the recording system according to the illustrated embodiments, an exchangeable recording means of cartridge type wherein an ink tank is formed integrally with a recording head, or a recording means of the type wherein a recording head and an ink tank are formed separately and these are connected to each other via coupler or tube can be used.

Figure 11:
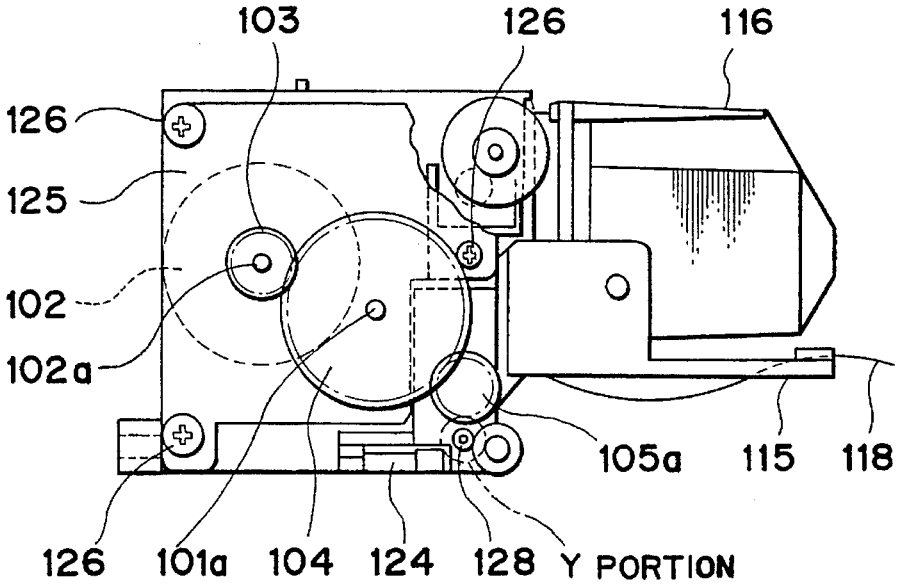
FIG. 11 is a left side view of the ink jet recording system of FIG. 10.
Figure 12:
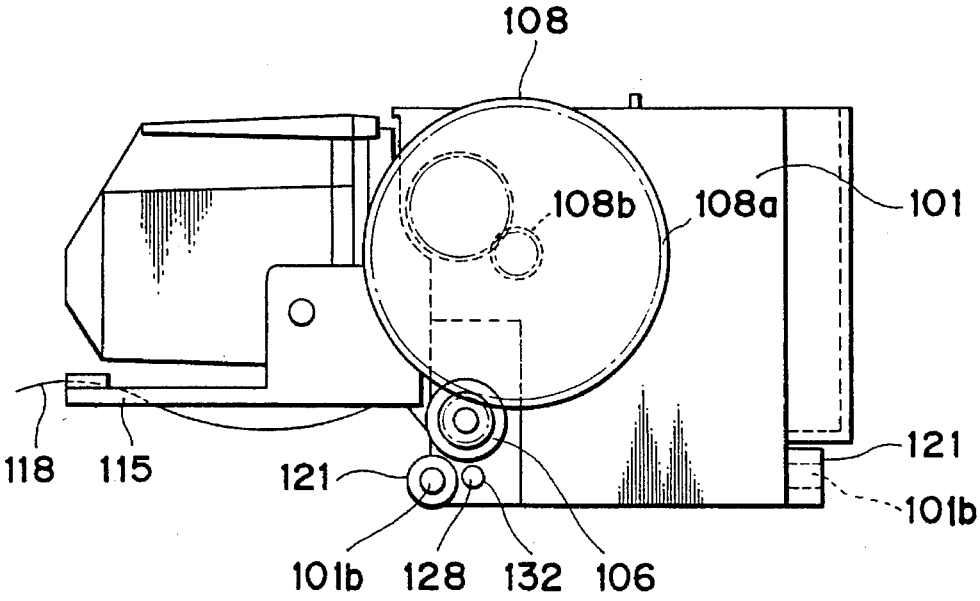
FIG. 12 is a right side view of the ink jet recording system of FIG. 10.
Figure 13:
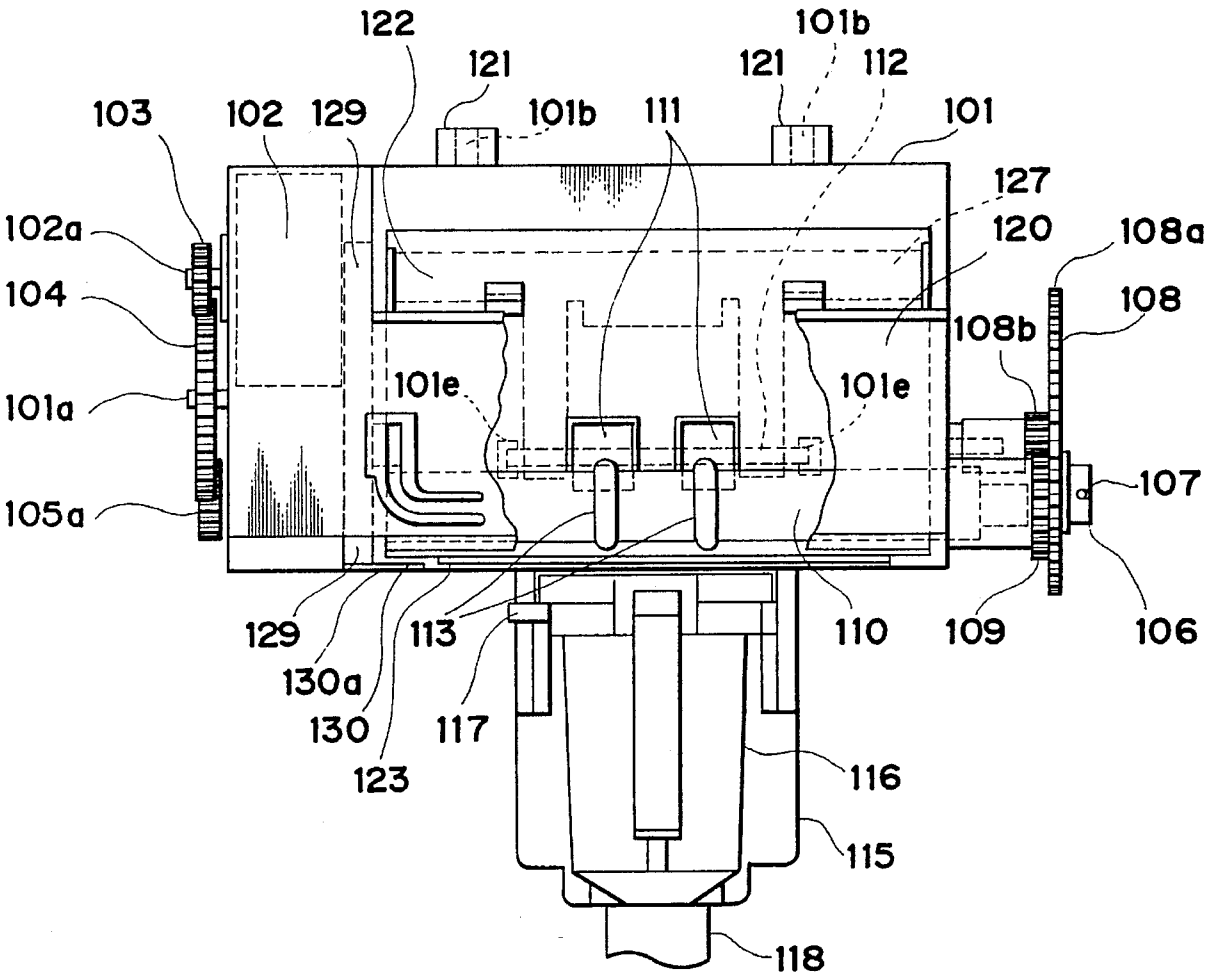
FIG. 13 is a plan view of the ink jet recording system of FIG. 10.
Figure 14:
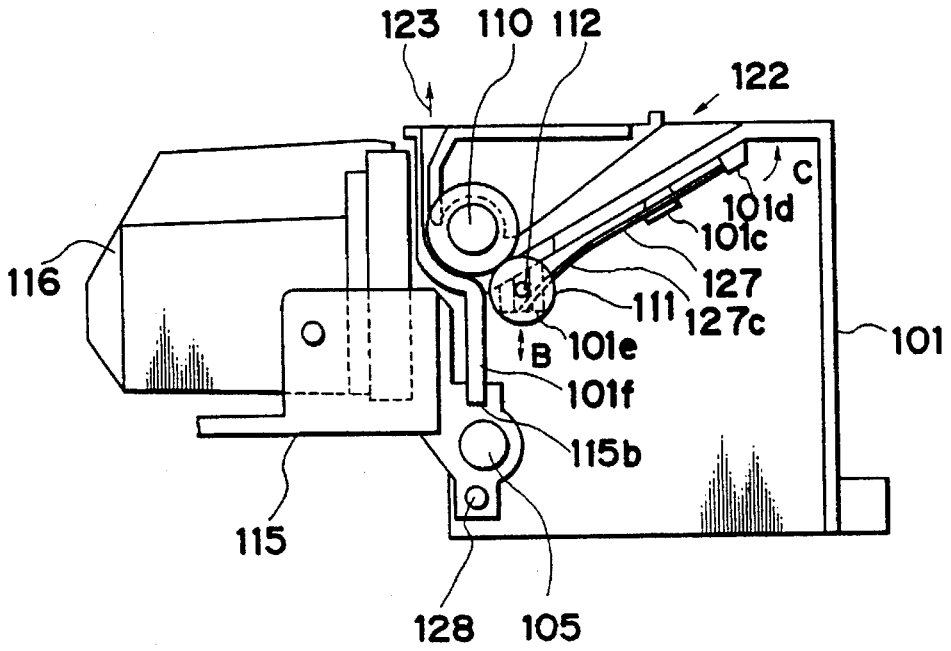
FIG. 14 is a sectional side view of the ink jet recording system, also showing a sheet feeding apparatus.

Next, a third embodiment wherein the present invention is applied to an ink jet recording system of serial type will be explained with reference to FIGS. 10 to 15D. Incidentally, FIG. 10 is an elevational view of a serial ink jet recording system according to a third embodiment of the present invention, FIG. 11 is a left side view of the serial ink jet recording system, FIG. 12 is a right side view of the serial ink jet recording system, FIG. 13 is a plan view of the serial ink jet recording system, and FIG. 14 is a sectional side view of the serial ink jet recording system including a sheet feeding apparatus, and FIGS. 15A–15D are explanatory views for explaining a supporting structure for a guide shaft.

Explaining first the whole construction of the serial ink jet recording system, the reference numeral 101 denotes a body frame of a serial ink jet recording system, to which a stepping motor 102 which is a drive source for shifting a carriage and for feeding a recording sheet is attached. The reference numeral 103 denotes a motor gear secured to a motor shaft 102*a* of the stepping motor 102. The motor gear 103 is meshed with a transmission gear 104 rotatably mounted on a shaft 101*a* supported by the body frame 101.

A gear portion 105*a* secured to one end of a lead screw 105 is meshed with the transmission gear 104. Further, a sheet feed transmission gear 106 is secured to the other end of the lead screw 105 by a lock pin 107. The lead screw 105 is inserted into holes formed in the body frame 101 for rotational movement. A sheet feed intermediate gear 108 comprises a gear portion 108*a* meshed with the sheet feed transmission gear 106 and a gear portion 108*b* meshed with a clutch gear 109. The sheet feed intermediate gear 108 is rotatably mounted on a shaft supported by the body frame 101.

Figure 10:
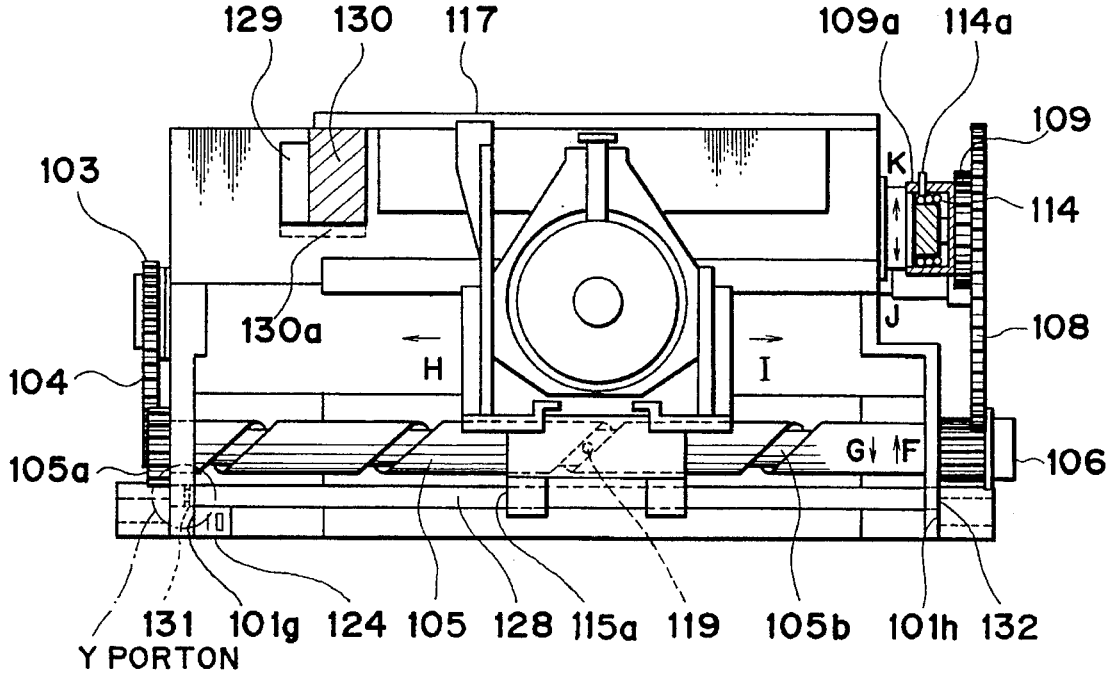
FIG. 10 is an elevational view of an ink jet recording system according to a further embodiment of the present invention.

In FIG. 10, an end 114*a* of a clutch spring 114 is engaged by a recessed portion 109*a* of the clutch gear 109, and the clutch spring 114 is wound around an end portion 110*a* of a sheet feed roller 110. The sheet feed roller 110 is inserted into a hole formed in the body frame 101 for rotational movement. Further, feed ring members 113 made of elastic material (for example, rubber material) are mounted around the sheet feed roller 110 at a central area thereof, and pinch rollers 111 are disposed in confronting relation to the feed ring members 113.

The pinch rollers 111 are rotatably mounted on a pinch roller shaft 112 which is received in recessed portions 101*e* formed on the frame 101 for rotational movement and shifting movement in directions B (FIG. 14). The pinch roller shaft 112 is urged against the sheet feed roller 110 by arm portions 127*c* of a pinch roller spring 127. The pinch roller spring 127 is secured to the body frame 101 via pinch roller spring receiving portions 101*c*, 101*d* of the frame. With this arrangement, when the sheet feed roller 110 is rotated, the sheet feed roller cooperates with the pinch rollers 111 to feed the recording sheet (recording medium).

Next, the construction of a recording means will be described.

In FIGS. 10 to 13, a recording head 116 constitutes a recording means and, in this embodiment, it is constructed as an ink jet recording head. This recording head 116 is provided with fine or small liquid discharge openings (orifices), liquid passages, energy acting portions disposed on parts of the liquid passages, and energy generating means for generating liquid droplet forming energy acting on the acting portions. Such energy generating may be, for example, a pressure energy generating means using electrical/mechanical converters such as piezo-electric elements, an electro-magnetic energy generating means for discharging liquid droplets by heating the liquid with electro-magnetic waves such as laser, or a thermal energy generating means for discharging liquid by heating the liquid by means of electrical/thermal converters such as heating resistive bodies. Among the recording heads, the recording head of ink jet recording type wherein the ink is discharged by using the thermal energy permits the recording with high resolving power, since the ink discharge openings (orifices) for discharging the ink droplets can be arranged with high density. Among them, the recording head utilizing the electrical/thermal converters as the energy generating means is particularly advantageous, since it can easily be made compact, the merits of IC techniques and/or micro-working techniques which have advanced remarkably progressed in technique and reliability in the semi-conductor field can be fully utilized, the high density arrangement-can easily be attained, and the manufacturing cost is low.

The recording head 116 is mounted on a carriage 115 which can be reciprocally shifted by the rotation of the lead screw 105, and receives a desired record signal from a control portion (not shown) via a flexible cable 118. Incidentally, in FIG. 13, the reference numeral 117 denotes a set lever for elastically and electrically connecting the flexible cable 118 to the recording head 116.

The lead screw 105 is provided at its peripheral surface with a spiral groove 105*b* into which a pin 119 formed on the carriage 115 is received. Incidentally, in FIG. 10, the reference numeral 128 denotes a guide shaft acting as a guide member for guiding the shifting movement of the carriage 115 in directions H, I. Thus, when the lead screw 105 is rotated, the carriage 115 is reciprocally shifted along the guide shaft 128. The attachment for the guide shaft 128 will be described later.

Further, in FIG. 14, the carriage 115 is provided with a recessed portion 115b engaged by a wall 101*f* of the frame 101. Thus, the carriage 115 is guided by the engagement between the recessed portion 115*b* and the wall 101*f*, as well as the above-mentioned guide shaft 128. Further, in FIG. 10, a detection switch 124 for detecting a home position of the carriage 115 is provided so that, when an end 115*a* of the carriage 115 shifted to the home position pushes the detection switch 124, the home position of the carriage is detected. Incidentally, in FIG. 12, a plurality of attachment leg portions 121 made of elastic material are inserted onto projections 101*b* formed on the body frame 101 to support the recording system.

A platen 120 is removably mounted on the body frame 101 to guide a recording sheet. The recording sheet is inserted into an inlet 122 (FIG. 14) and is ejected from an outlet 123.

Next, the attachment structure for the guide shaft 128 will be explained.

FIGS. 15A–15D show a Y portion in FIG. 10 with more detail. In this embodiment, the guide shaft 128 is provided at its one end with a groove 128*a* to constitute a support portion. Further, body side plates 101*g*, 101*h* of the body frame 101 are provided with opposed through holes 131, 132, and an elastically deformable rib 131*a* constituting a guide shaft supporting portion is formed on an inner peripheral surface of the through hole 131. The dimension of the rib 131*a* corresponds to the dimension of the groove 128*a* of the guide shaft 128.

Figure 15A:
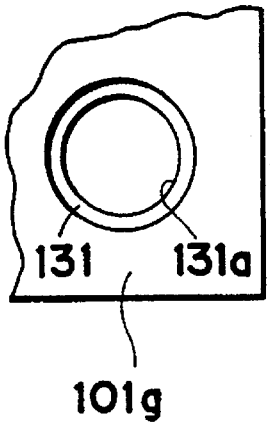
FIGS. 15A–15D are sectional views showing a supporting structure for a guide shaft.
Figure 15B:
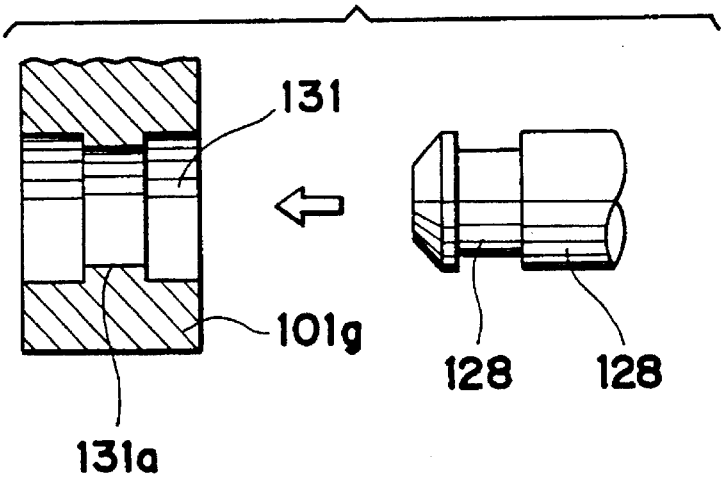
Figure 15C:
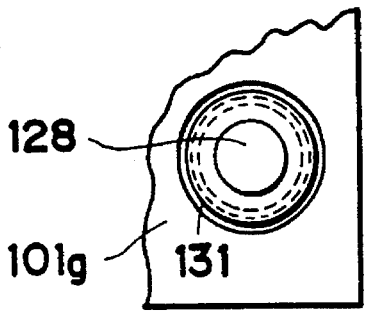
Figure 15D:
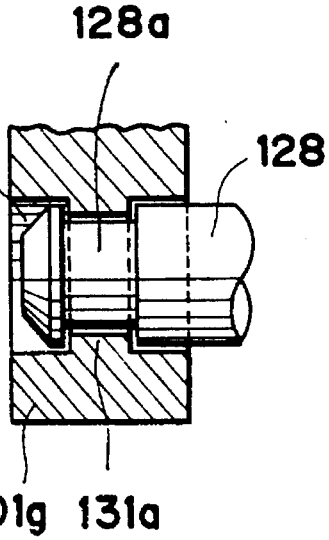
Figure 16A:
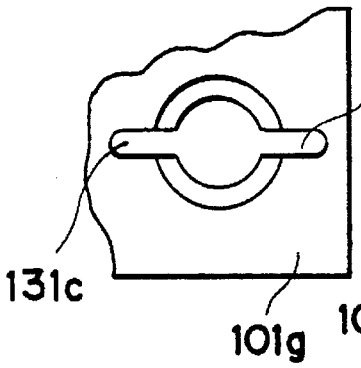
FIGS. 16A–16D are sectional views showing a supporting structure for a guide shaft according to another embodiment.
Figure 16B:
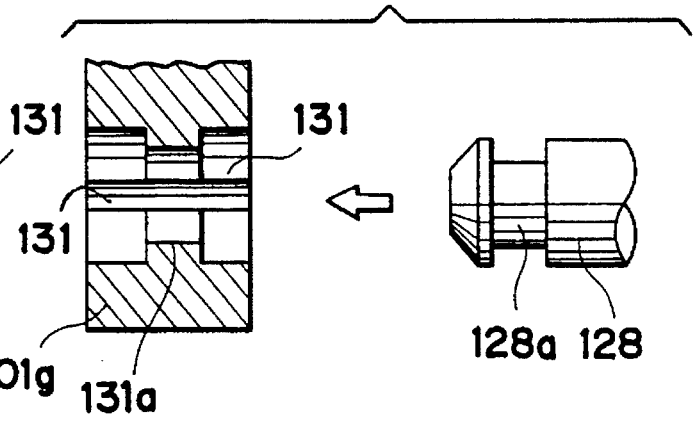
Figure 16C:
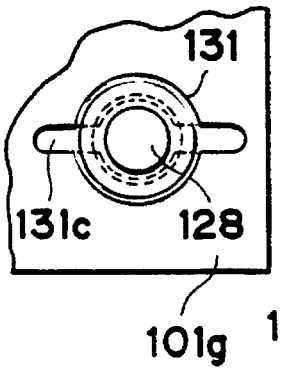
Figure 16D:
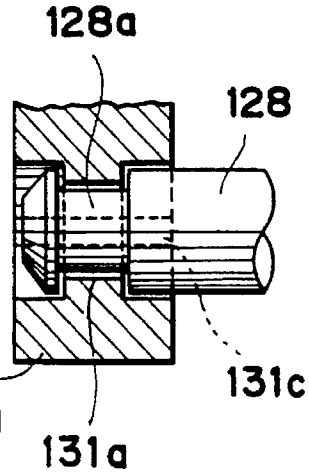
Figure 17A:
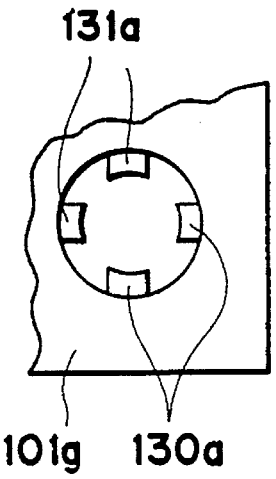
FIGS. 17A–17D are sectional views showing a supporting structure for a guide shaft according to a further embodiment.
Figure 17B:
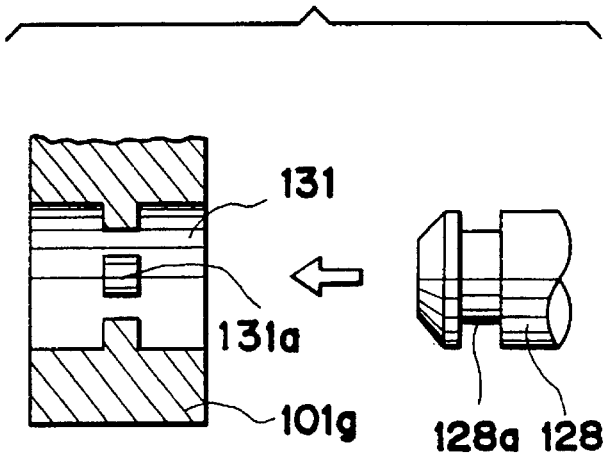
Figure 17C:
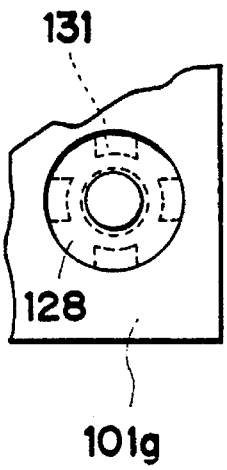
Figure 17D:
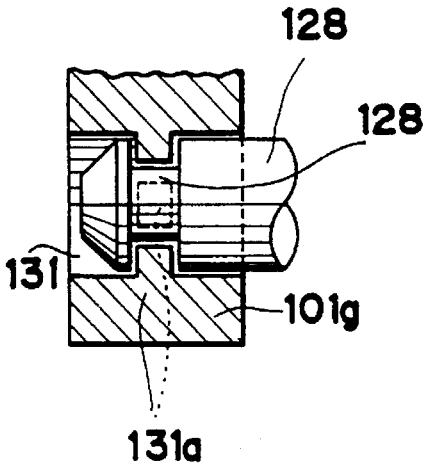

In FIGS. 15A and 15B, one end of the guide shaft 128 inserted from the through hole 132 is inserted into the through hole 131 of the side plate 101*g* while elastically deforming the rib 131*a* circumferentially. When the rib 131*a* is fitted into the groove 128*a* of the guide shaft 128, the guide shaft is grippingly secured to the side plate, thus preventing the guide shaft 128 from being moved in the longitudinal direction. This condition is shown in FIG. 15B. In this condition, the other end of the guide shaft 128 is fitted into the through hole 132 of the side plate 101*h*, and, thus, both ends of the guide shaft 128 are supported and fixed by the through holes 131, 132.

In this way, it is possible to non-detachably secure the guide shaft 128 to the body frame 101 merely by inserting or fitting the guide shaft into the through holes 131, 132 of the side plates 101*g*, 101*h*. Thus, unlike conventional cases, since E-rings and the like are not required, the number of parts can be reduced and a lower cost can be achieved.

Next, the recording operation of the recording system will be explained. When the motor 102 is rotated in the predetermined direction in response to the drive signal from the control portion (not shown), the lead screw 105 is rotated in the direction F in FIG. 10. Consequently, the carriage 115 is shifted in the direction H along the guide shaft 128 via the pin 119 engaged by the spiral groove 105*b* of the lead screw.

When the carriage is shifted by the predetermined amount, the end portion 115*a* of the carriage 115 turns the detection switch 124 ON, thus ascertaining the home position. At this point, the drive signal to the motor 102 is reversed to rotate the lead screw 105 in the direction G, thus shifting the carriage 115 in the direction I. After the carriage is shifted in the direction I by the predetermined amount, a record signal is selectively applied to the recording head 116, thus performing the recording on the recording sheet.

The shifting movement of the carriage 115 in the direction I, i.e., the rotation of the lead screw 105 in the direction G is transmitted to the sheet feed transmission gear 106 and the sheet feed intermediate gear 108, thereby rotating the clutch gear 109 in a direction J. In this case, however, since the clutch gear is rotated to loosen the clutch spring 114, a rotational force is not transmitted to the feed roller 110, with the result that the recording medium is not fed or moved.

After the recording is performed on the recording sheet while the carriage 115 is being shifted in the direction I by the predetermined amount, the drive signal to the motor 102 is reversed again to rotate the lead screw 105 in the direction F, thereby shifting the carriage 115 in the direction H. In this case, the clutch gear 109 is rotated in direction K so that the clutch spring 114 is tightened to drive the end portion 110*a* of the feed roller 110. Consequently, the feed roller 110 is driven, thereby line-spacing the recording medium by a predetermined amount. In this way, the predetermined recording is effected by shifting the carriage 115 along the guide shaft 128.

FIGS. 16A–16D show another embodiment of a support portion of the guide shaft 128 and a guide shaft supporting portion of the side plate 101*g*. In this embodiment, at least one cut-out recess 131*c* is formed in the inner peripheral surface of the through hole 131 shown in the aforementioned embodiment, so that the through hole can more easily be elastically deformed in the circumferential direction, thereby better facilitating the insertion of the guide shaft 128 into the through hole.

FIGS. 17A–17D show a further embodiment, wherein the continuous rib formed in the through hole 131 shown in the aforementioned embodiment is divided into a plurality of rib segments 131*a* so that the flexibility of the rib is improved, thereby better facilitating the insertion of the guide shaft 128 into the through hole.

Figure 18A:
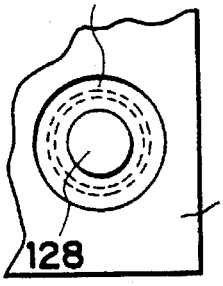
FIGS. 18A and 18B are sectional views showing a supporting structure for a guide shaft according to a still further embodiment.
Figure 18B:
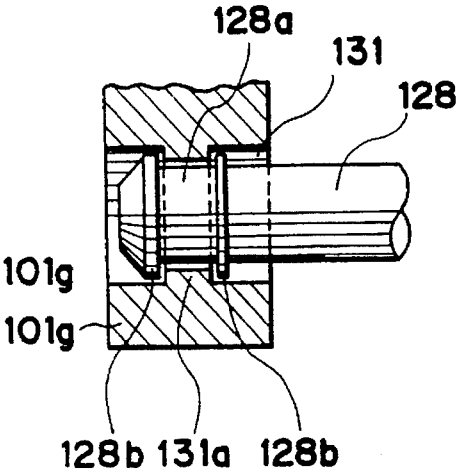

FIGS. 18A and 18B show a still further embodiment, wherein in place of the groove 128*a* shown in the above-mentioned embodiments, flanges 128*b* are formed on one end of the guide shaft 128 so that a groove 128*a* is defined between the flanges.

Figure 19A:
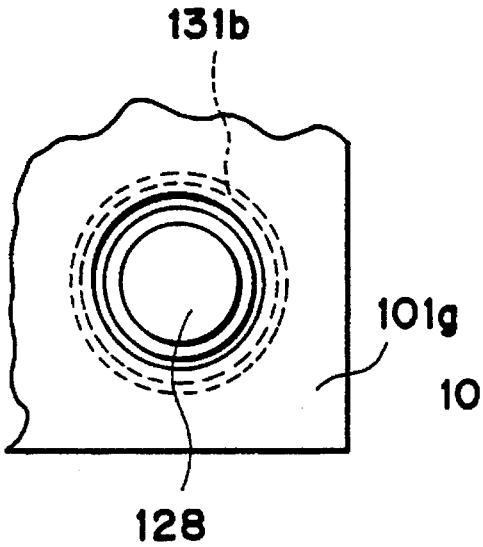
FIGS. 19A and 19B are sectional views showing a supporting structure for a guide shaft according to a further embodiment.
Figure 19B:
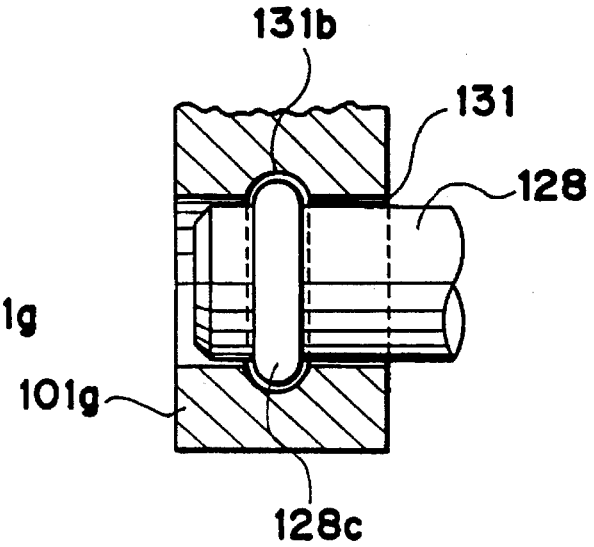

FIGS. 19A and 19B show a further embodiment, wherein the rib on the inner surface of the through hole 131 and the groove 128*a* in the guide shaft 128 shown in the embodiment of FIG. 15 are exchanged. That is to say, a groove 131*b* is formed in the inner surface of the through hole 131 and an annular projection 128*c* is formed on the guide shaft 128, which can be engaged by each other.

Figure 20A:
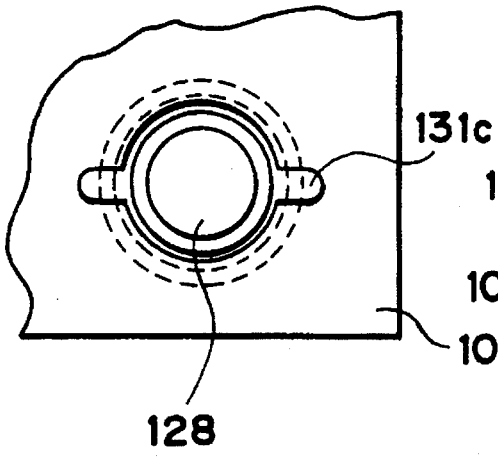
FIGS. 20A and 20B are sectional views showing a supporting structure for a guide shaft according to the other embodiment.
Figure 20B:
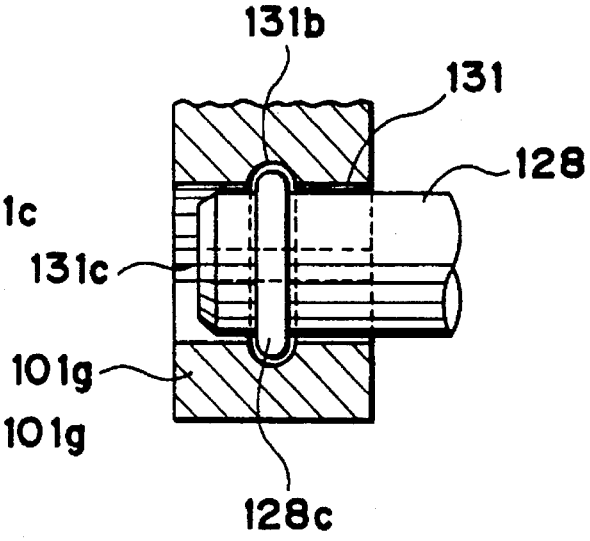
Figure 21:
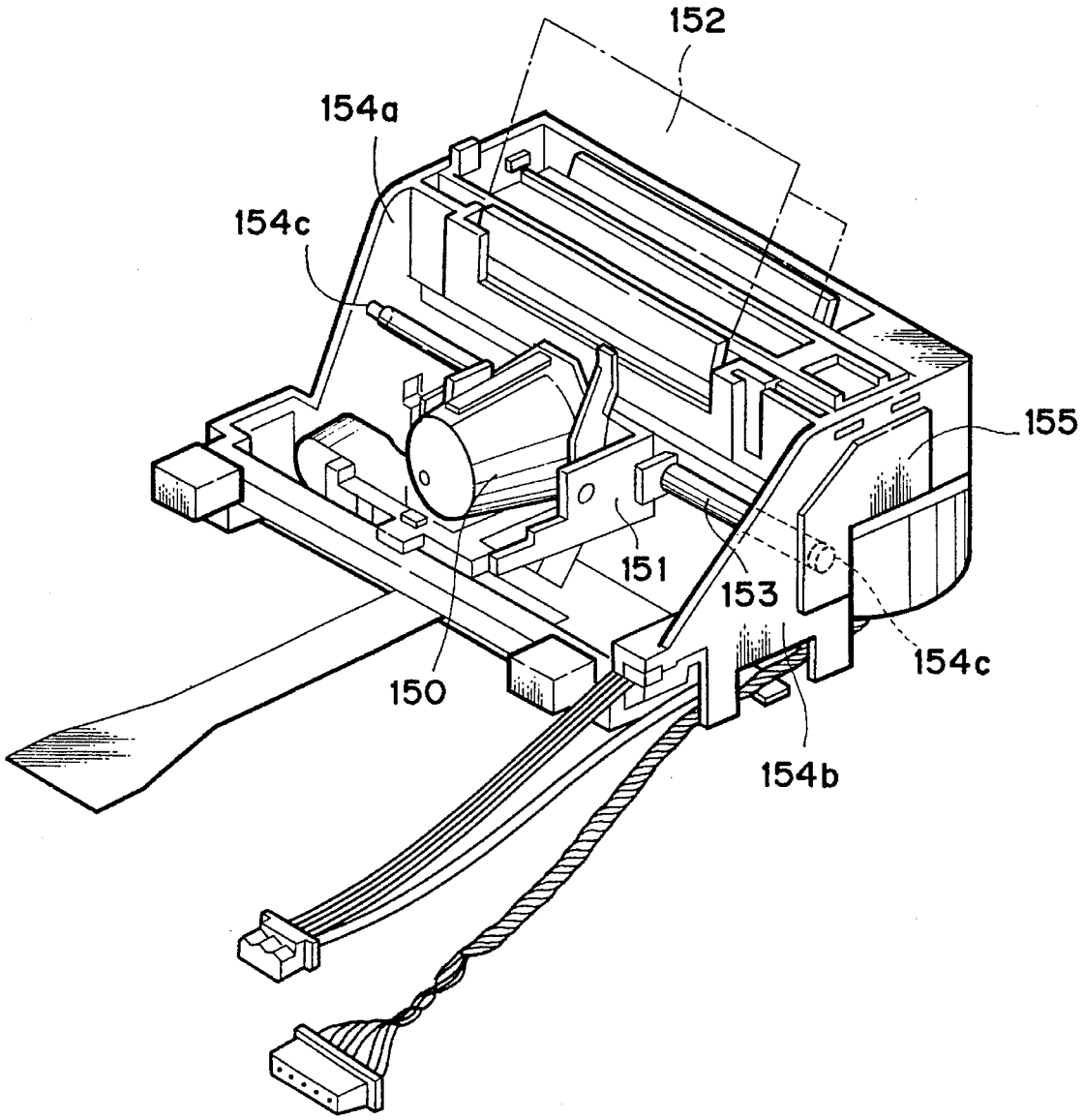
FIG. 21 is a perspective view of a conventional recording system.

FIGS. 20A and 20B show the other embodiment, wherein the rib on the inner surface of the through hole 131 and the groove 128*a* in the guide shaft 128 shown in the embodiment of FIG. 16 are exchanged. That is to say, a groove 131*b* is formed in the inner surface of the through hole 131 and an annular projection 128*c* is formed on the guide shaft 128, which can be engaged by each other.

In the above-mentioned embodiments, while the groove or the projections was formed on one end of the guide shaft 128 to forcibly engage by the rib or the groove formed on the inner surface of the through hole 131 of the side plate 101*g*, these elements may be formed on both ends of the guide shaft 128 to forcibly engage by the corresponding elements formed on both through holes of the side plates 101*g*, 101*h*.

Although the present invention can be applied to a recording system using a recording means (recording head) including electrical/thermal converters such as piezo-electric elements if the recording system is of the ink jet type, particularly excellent benefits can be obtained when the present invention is applied to an ink jet recording system of the type wherein the ink is discharged by utilizing thermal energy, since it is possible to obtain the image with high density and with high resolving power.

It is preferable to employ the typical structure and the principle of structures disclosed in, for example, U.S. Pat. Nos. 4,723,129 and 4,740,796. This system can be adopted in a so-called "On-Demand" type and "Continuous" type structures. In this system, an electrothermal conversion member disposed to align to a sheet or a liquid passage in which liquid (ink) is held is supplied with at least one drive signal which corresponds to information to be recorded and which enables the temperature of the electrothermal conversion member to be raised higher than a nucleate boiling point, so that thermal energy is generated in the electrothermal conversion member and film boiling is caused to take place on the surface of the recording head which is heated. As a result, bubbles can be respectively formed in liquid (ink) in response to the drive signals. Due to the enlargement and contraction of the bubble, liquid (ink) is discharged through the discharge port, so that at least one droplet is formed. In a case where the aforesaid drive signal is shaped as a pulse signal, a further satisfactory effect can be obtained in that the bubble can immediately and properly be enlarged/contracted and liquid (ink) can be discharged while exhibiting excellent responsiveness. It is preferable to employ a drive signal of the pulse signal type disclosed in U.S. Pat. Nos. 4,463,359 and 4,345,262. Furthermore, in a case where conditions for determining the temperature rise ratio on the aforesaid heated surface disclosed in U.S. Pat. No. 4,313,124 are adopted, a further excellent recording operation can be performed.

In addition to the structure (a linear liquid passage or a perpendicular liquid passage) of the recording head formed by combining the discharge ports, the liquid passage and the electrothermal conversion member as disclosed in the aforesaid specifications, a structure disclosed in U.S. Pat. Nos. 4,558,333 and 4,459,600 in which the heated portion is disposed in a bent portion is included in the scope of the present invention. Furthermore, the present invention can effectively be embodied in a structure in which a common slit is made to be the discharge portion of a plurality of electrothermal conversion members and which is disclosed in Japanese Patent Laid-Open No. 59-123670 and a structure in which an opening for absorbing thermal energy pressure wave is formed to align to the discharge port and which is disclosed in Japanese Patent Laid-Open No. 59-138461.

A full line type recording head having a length which corresponds to the width of the maximum recording medium which can be recorded by the recording apparatus may be a structure capable of realizing the aforesaid length and formed by combining a plurality of recording heads as disclosed in the aforesaid specifications or a structure formed by a integrally formed recording head. The present invention will enable the aforesaid effects to be exhibited further effectively.

In addition, the present invention can also be effectively adapted to a structure having an interchangeable chip type recording head which can be electrically connected to the body of the apparatus or to which ink can be supplied from the body of the apparatus when it is mounted on the body of the apparatus or a cartridge type recording head integrally formed to the recording head.

It is preferable to additionally provide the recording head recovery means and an auxiliary means of the recording apparatus according to the present invention because the effect of the present invention can further be stabilized. Specifically, an effect can be obtained in that the recording operation can be stably performed by providing a recording head capping means, a cleaning means, a pressurizing or sucking means, an electrothermal conversion member or another heating device or an auxiliary heating means formed by combining the aforesaid elements and by performing a previous discharge mode in which a discharge is performed individually from the recording operation.

Furthermore, the recording mode of the recording apparatus may be a recording mode for recording only a main color such as black and a structure may be that formed by integrally forming recording heads or a structure formed by combining a plurality of recording heads. The present invention can significantly effectively be adapted to an apparatus having a recording head of a plurality of colors or at least one full color head arranged to mix colors.

Although the aforesaid embodiments use liquid ink, ink which is solid at room temperature or ink which is softened at room temperature can be used. In the aforesaid ink jet apparatus, the temperature of ink is usually controlled in a range from 30° C. to 70° C. to make the viscosity of ink to be in a stable discharge range and thereby ink which is liquefied in response to a record signal supplied may be used. Furthermore, ink the temperature rise of which is prevented by positively using the temperature rise due to the thermal energy as energy of state change from the solid state to the liquid state of ink or ink which is solidified when it is allowed to stand in order to prevent the evaporation of ink may be used. That is, ink which is liquefied by thermal energy such as energy supplied in response to the record signal and which is discharged as ink droplet or ink which is solidified when it reaches the recording medium can be employed in the present invention. In this case, ink may be, in the form of liquid or solid, held by a recess of a porous sheet or a through hole as disclosed in Japanese Patent Laid-Open No. 54-56847 or Japanese Patent Laid-Open No. 60-71260 and disposed to confront the electrothermal conversion member. It is most preferable that ink be discharged by the aforesaid film boiling method.

In addition, the ink jet recording head according to the present invention can be used as a copying machine combined with a reader, facsimile system having the communication function, and the like, as well as an image output terminal of an information processing equipment such as a computer.

As apparent from the aforementioned explanations, according to the present invention, in the ink jet recording system having the recording means for performing the recording by discharging the ink onto the recording medium, since a position of the ink receiving portion for receiving the ink discharged other than the normal recording operation is arranged within the width zone of the recording medium, it is possible to eliminate the additional space for receiving the ink discharged other than the normal recording operation (for example, by the preliminary discharge), and, therefore, to reduce the widthwise dimension of the recording system accordingly, thereby making the recording system small-sized and light-weight.

Further, as mentioned above, since the guide member can be fixedly mounted on the body frame by inserting the support portion provided on the end(s) of the guide member into the guide member supporting portion formed in at least one side plate of the body frame while elastically deforming the supporting member, it is possible to fixedly attach the guide member to the body frame without any fastener elements as in the conventional cases. Thus, the number of parts and the number of assembling steps can be reduced, thereby achieving the cost reduction.

What is claimed is:

1. An ink jet recording apparatus for effecting a recording by discharging an ink from a recording head to a recording medium, comprising:

a platen opposed to said recording head for supporting said recording medium in order to convey said recording medium; and an ink receiving portion for receiving the ink discharged from said recording head but which is not used for recording, said ink receiving portion being disposed within a conveying area of said platen and next to and out of a recording area of the recording medium in a lateral direction of said platen, and in a space between said platen and said recording head.

2. An ink jet recording apparatus according to claim 1, wherein an ink absorber is provided adjacent to said ink receiving portion.

3. An ink jet recording system according to claim 1, wherein said ink receiving portion includes an ink absorber therein.

4. An ink jet recording system according to claim 1, wherein said recording means comprises an ink jet recording means having an electrical/thermal converter means for generating thermal energy utilized to discharge the ink.

5. An ink jet recording system according to claim 1, wherein said recording means discharges the ink from a discharge opening by utilizing the film boiling created in the ink by the thermal energy generated by said electrical/thermal converter means.

6. An ink jet recording system according to claim 1, further comprising:

a carriage shifting apparatus including a body frame, a carriage reciprocally shiftable within said body frame, and a guide member having both ends supported by both side plates of said body frame and adapted to guide the shifting of said carriage, and wherein a support portion provided on at least one end of said guide member is non-detachably attached to at least one of said side plates by fitting said support portion into a guide member supporting portion provided in said one of the guide plates after elastically deforming said guide member supporting portion;

a recording means mounted on said carriage and adapted to perform the recording on a recording medium; and a feeding means for feeding the recording medium.

7. A carriage shifting apparatus comprising:

a body frame;

a carriage reciprocally shiftable within said body frame; and a guide member having both ends supported by both side plates of said body frame and adapted to guide the shifting of said carriage;

and wherein a support portion provided on at least one end of said guide member is non-detachably attached to at least one of said side plates by fitting said support portion into a guide member supporting portion provided in said one of the guide plates after elastically deforming said guide member supporting portion.

8. A carriage shifting apparatus according to claim 7, wherein said support portion of said guide member comprises a groove or a projection, and said guide member supporting portion of said body frame comprises a through hole on an inner peripheral surface of which a projection or a groove capable of fitting in or on said groove or projection of said support portion is formed.

9. A recording system comprising:

a carriage shifting apparatus including a body frame, a carriage reciprocally shiftable within said body frame, and a guide member having both ends supported by both side plates of said body frame and adapted to guide the shifting of said carriage, and wherein a support portion provided on at least one end of said guide member is non-detachably attached to at least one of said side plates by fitting said support portion into a guide member supporting portion provided in said one of the guide plates after elastically deforming said guide member supporting portion;

a recording means mounted on said carriage and adapted to perform the recording on a recording medium; and a feeding means for feeding the recording medium.

10. A recording system according to claim 9, wherein the recording system is of ink jet recording type in which the recording is performed by discharging ink in response to a signal.

11. A recording system according to claim 10, wherein the recording system is of ink jet recording type in which the recording is performed by discharging ink by utilizing thermal energy generated by an electrical/thermal converter means of said recording means energized in response to a signal.

12. A recording system according to claim 11, wherein the recording system is of ink jet recording recording type in which the recording is performed by discharging ink by the growth of a bubble due to the film boiling caused by said electrical/thermal converter means of said recording means energized in response to the signal.

* * * * *

UNITED STATES PATENT AND TRADEMARK OFFICE

CERTIFICATE OF CORRECTION

PATENT NO. : 5,480,243

DATED : January 2, 1996

INVENTORS : SHOSKI KIKKAWA ET AL.

It is certified that error appears in the above-identified patent and that said Letters Patent is hereby corrected as shown below:

ON COVER PAGE

At [57] Abstract

Line 13, "ends" should read --end--.

In the Drawings:

SHEET 8 OF 16

Fig. 10, "PORTON" should read --PORTION--.

COLUMN 2

Line 18, "ON.." should read --ON.--

COLUMN 3

Line 24, "discharge" should read --discharging--.
Line 39, "medim)," should read --medium),--.
Line 51, "during" should read --the--.

COLUMN 8

Line 14, ".selected" should read --selected--.

UNITED STATES PATENT AND TRADEMARK OFFICE

CERTIFICATE OF CORRECTION

PATENT NO. : 5,480,243

DATED : January 2, 1996

INVENTORS : SHOSHI KIKKAWA ET AL.

It is certified that error appears in the above-identified patent and that said Letters Patent is hereby corrected as shown below:

COLUMN 15

Line 41, "system" should read --apparatus--.
Line 44, "system" should read --apparatus--.
Line 48, "system" should read --apparatus--.
Line 53, "system" should read --apparatus--.

COLUMN 16

Line 21, "guide" should read --side--.
Line 40, "guide" should read --side--.
Line 56, "recording recording" should read --recording--.

Signed and Sealed this

Fourteenth Day of October, 1997

*Attest:*

Bruce Lehman

BRUCE LEHMAN

*Attesting Officer*

*Commissioner of Patents and Trademarks*